US008033841B2

(12) United States Patent
He

(10) Patent No.: US 8,033,841 B2
(45) Date of Patent: Oct. 11, 2011

(54) UPRIGHT ELECTRICAL CONNECTOR

(75) Inventor: Jia-Yong He, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/980,364

(22) Filed: Dec. 29, 2010

(65) Prior Publication Data

US 2011/0159746 A1 Jun. 30, 2011

(30) Foreign Application Priority Data

Dec. 30, 2009 (CN) ..... 2009 1 0312551

(51) Int. Cl.
*H01R 13/548* (2006.01)
*H01R 4/66* (2006.01)

(52) U.S. Cl. ..... 439/108

(58) Field of Classification Search ..... 439/79, 439/80, 660, 607.23, 607.35, 108
See application file for complete search history.

(56) References Cited

U.S. PATENT DOCUMENTS 5,725,386 A * 3/1998 Davis et al. ..... 439/79
6,109,935 A * 8/2000 Yang ..... 439/80
6,135,790 A * 10/2000 Huang et al. ..... 439/79
6,390,227 B1 * 5/2002 Abend et al. ..... 180/375
7,674,118 B2 * 3/2010 He ..... 439/108
7,717,745 B2 * 5/2010 He et al. ..... 439/607.23
7,744,382 B2 * 6/2010 Zheng et al. ..... 439/79
7,744,418 B2 * 6/2010 He et al. ..... 439/607.35
7,798,854 B2 * 9/2010 Tanaka ..... 439/108
7,841,905 B2 * 11/2010 Zheng et al. ..... 439/660
2009/0042450 A1 * 2/2009 Zheng et al. ..... 439/660

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector (100) includes an insulative housing (1), a metal shell (4), and a set of first contacts (2) retained in the insulative housing. The insulative housing has a base portion (111) and a tongue plate (112) extending forwardly from the base portion and being upright. The metal shell covers the insulative housing and forms a receiving space (41) with the tongue plate extending therein. The first contacts have first contacting portions (210) arranged in one row along a height direction of the electrical connector, first tail portions (220) extending outwardly beyond the insulative housing, and first connecting portions. The first contacts include a first pair of differential contacts (23) including an upper contact (231) and a lower contact (232) located under the upper contact. Total lengths of the upper and lower contacts (231, 232) are substantially equal.

19 Claims, 9 Drawing Sheets

UPRIGHT ELECTRICAL CONNECTOR

BACKGROUND OF THE INVENTION

1. Field of the Invention

The present invention relates to an electrical connectors, and more particularly to an upright electrical connector.

2. Description of Related Art

Universal Serial Bus (USB) is used widely in variety electronic devices as a standard and simple interface. The standard USB 3.0 receptacle comprises an insulative housing, a plurality of first and second contacts received in the insulative housing and a metal shell covering the insulative housing. The insulative housing has a base and a tongue extending horizontally and forwardly from the base.

As a miniaturized development of electronic industry, the standard USB 3.0 can not be satisfied the requirement of many electric devices because it need a large mounting space thereof. For adapting to the miniaturized development of the electric industry, another type of USB 3.0 receptacle which we said upright USB 3.0 receptacle is born. The upright USB 3.0 receptacle stands up for decreasing the mounting area thereof A tongue plate of the upright USB receptacle extends uprightly. The first contacts have stiff first contacting portions retained in the tongue plate and arranged in one row along a height direction of the electrical connector. The second contacts have resilient second contacting portions retained in the tongue plated and arranged in one row located behind the first contacting portions. The first contacts comprise two pairs of differential contacts and a grounding contact located therebetween. Each pair of differential contacts in the upright USB 3.0 receptacle comprises an upper contact and a lower contact located under the upper contact.

However, in each pair of the differential contacts, the upper contact has a total length longer than that of the lower contact. The upper and lower contacts with different lengths can not transmit signals synchronously, and that may cause signal skew or out of timing sequence.

Hence, an improved electrical connector is desired to overcome the above problems.

BRIEF SUMMARY OF THE INVENTION

According to the present invention, an electrical connector for being mounted onto a printed circuit board comprises an insulative housing defining a base portion sitting downwardly onto the printed circuit board, and a tongue plate extending forwardly from the base portion and being upright related to the printed circuit board; a metal shell covering the insulative housing and defining a receiving space with the tongue plate extending therein; and a plurality of first contacts retained in the insulative housing and defining first contacting portions attached to a side of the tongue plate to be exposed to the receiving space and arranged in one row along a height direction of the electrical connector, first tail portions extending outwardly beyond the insulative housing for being mounted onto the printed circuit board, and first connecting portions connecting the first contacting portions and the first tail portions, the first contacts comprising at least a first pair of differential contacts including an upper contact and a lower contact located under the upper contact. Wherein total lengths of the upper and lower contacts are substantially equal.

According to another aspect of the present invention, an upright electrical connector for being mounted onto a printed circuit board comprises an insulative housing defining a base portion and a tongue plate extending forwardly from the base portion; a plurality of first contacts defining first contacting portions retained in the tongue plate and arranged in one row along a height direction of the electrical connector, first tail portions extending outwardly beyond the insulative housing for being mounted onto the printed circuit board, and first connecting portions connecting the first contacting portions and the first tail portions, the first connecting portions having first horizontal portions extending backwardly from the first contacting portions along a front-to-back direction, and first vertical portions perpendicular to the first horizontal portions and connecting the first horizontal portions and the first tail portions, the first contacts comprising two pairs of differential contacts and a grounding contact located therebetween, each pair of differential contacts including an upper contact and a lower contact located under the upper contact. Wherein the first horizontal portion of the lower contact has a length longer than that of the first horizontal portion of the corresponding upper contact, the first vertical portion of the lower contact has a length shorter than that of the first vertical portion of the corresponding upper contact, in each pair of differential contacts, the upper contact has a total length substantially equal to that of the lower contact.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
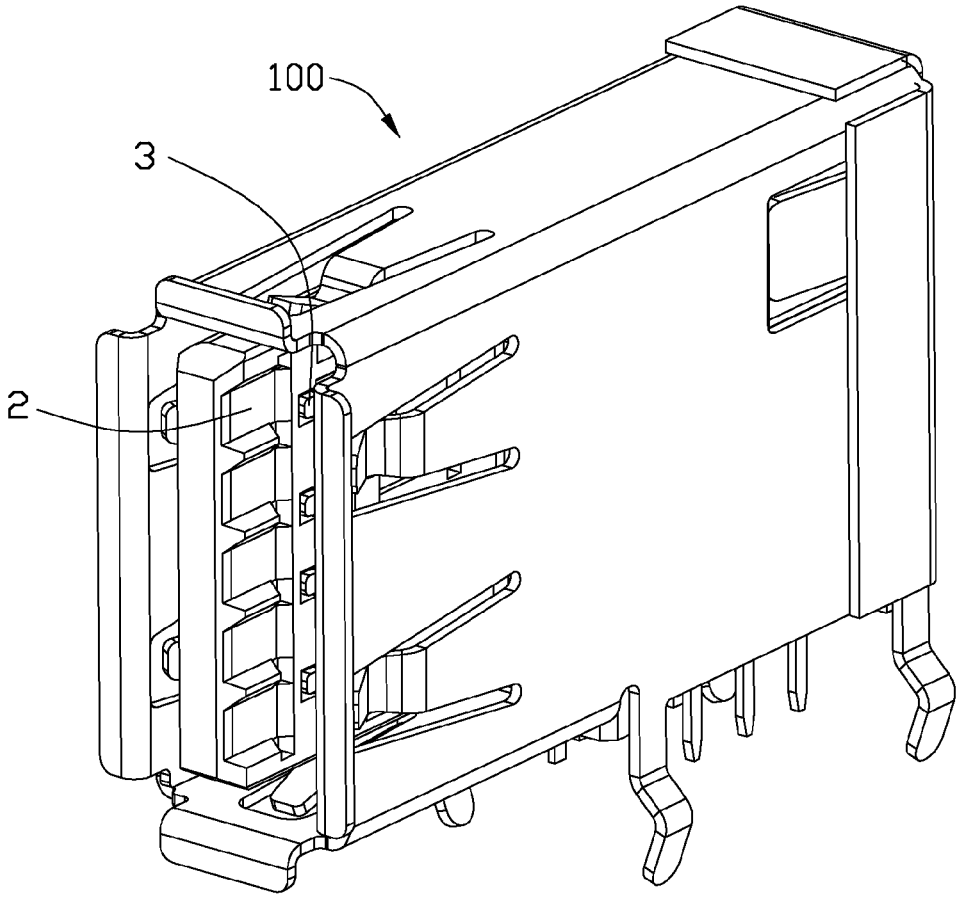
FIG. 1 is a perspective view of an electrical connector according to a first embodiment of the present invention.
Figure 2:
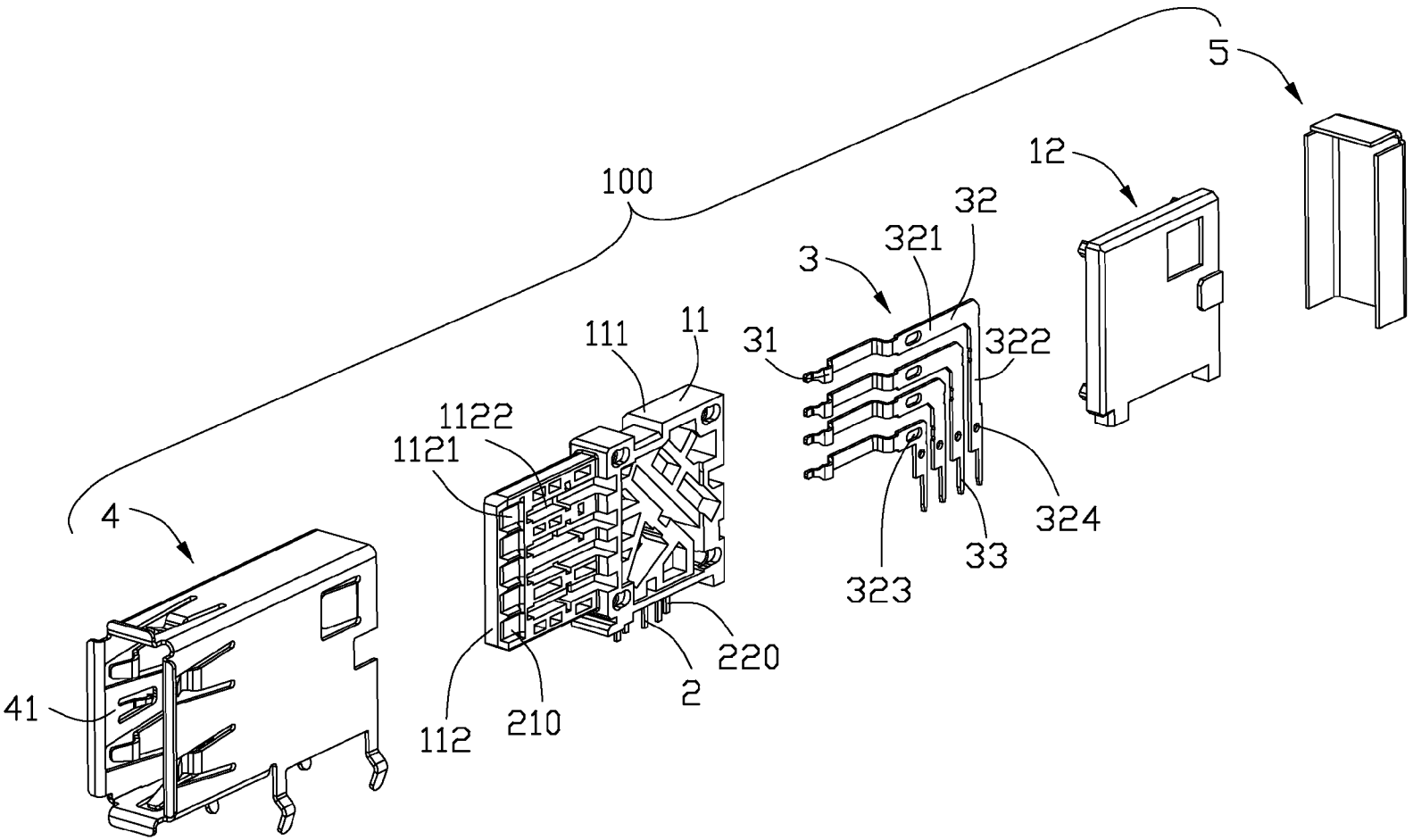
FIG. 2 is a partially exploded view of the electrical connector shown in FIG. 1.
Figure 3:
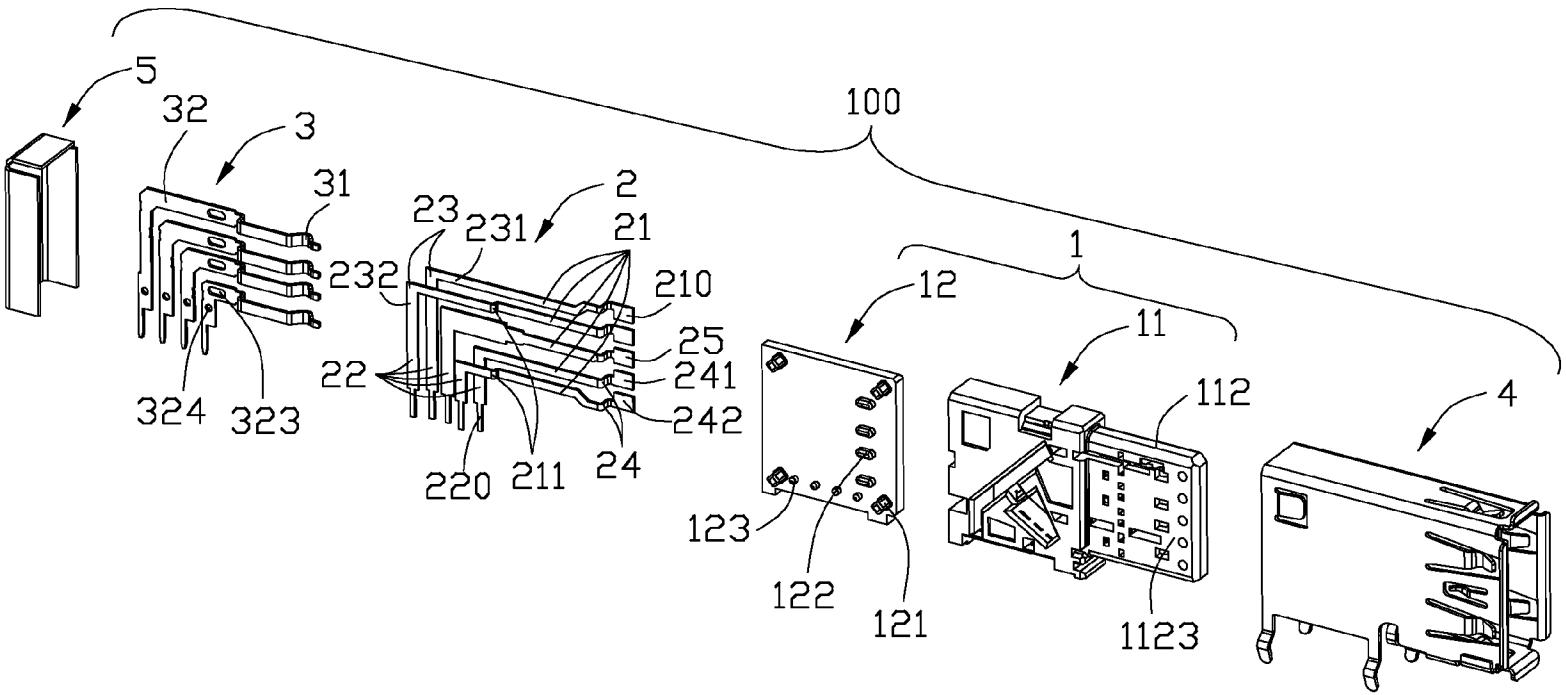
FIG. 3 is an exploded view of the electrical connector shown in FIG. 1.
Figure 4:
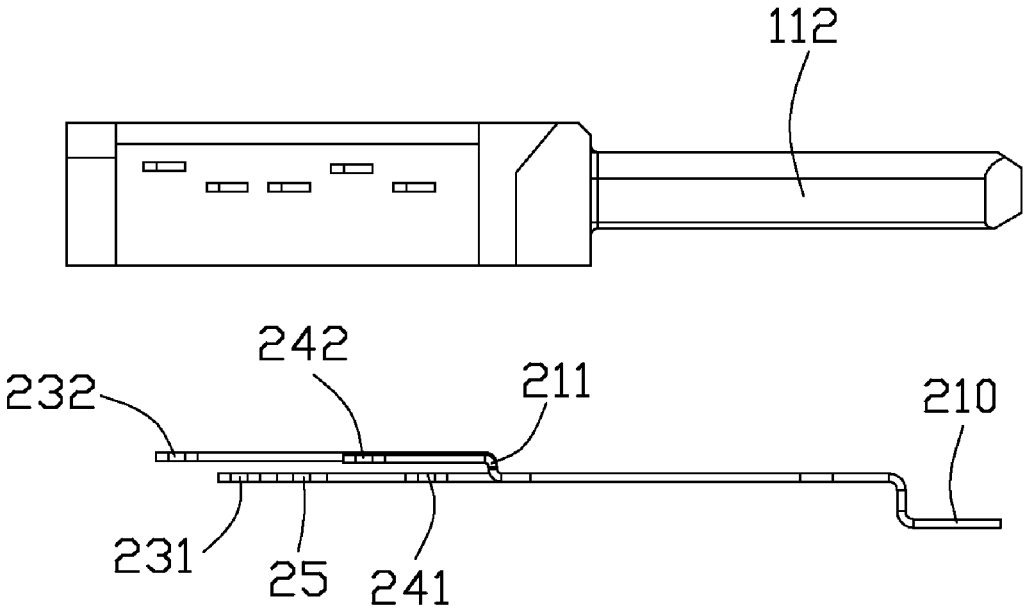
FIG. 4 is a bottom plan view of first contacts and first housing of the electrical connector shown in FIG. 1.
Figure 5:
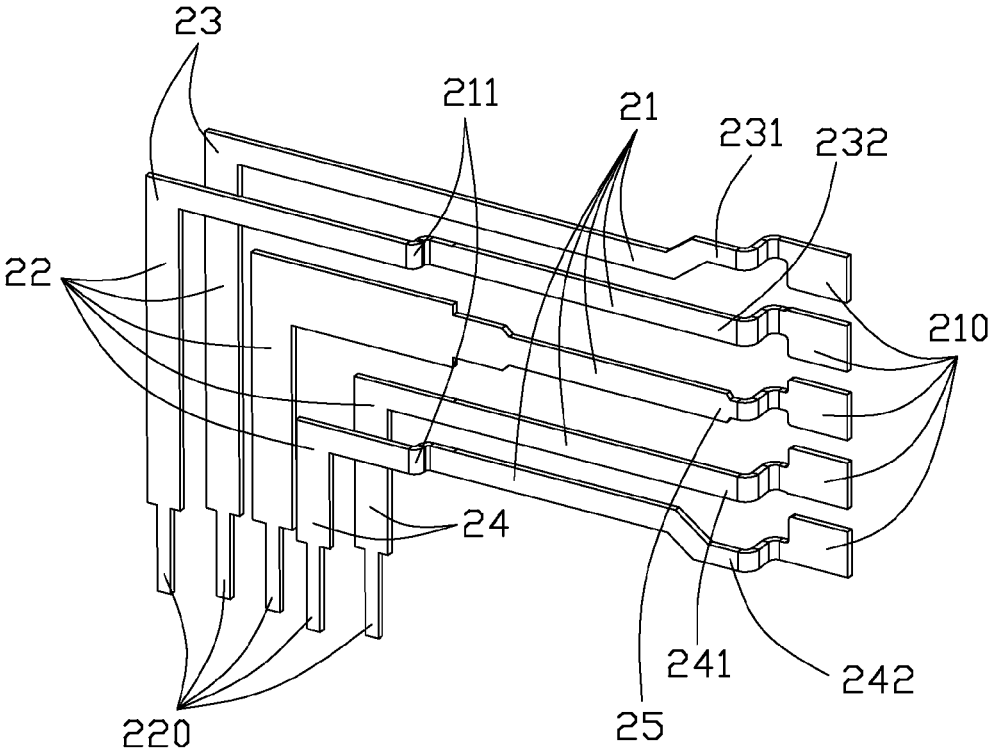
FIG. 5 is an enlarged view showing the first contacts of the electrical connector shown in FIG. 1.

Referring to FIGS. 1-5, an electrical connector 100 according to a first embodiment of the present invention for being mounted onto a printed circuit board (PCB hereinafter, not shown) in an upright position is disclosed. The electrical connector 100 is an A-type USB 3.0 receptacle and comprises an insulative housing 1, a plurality of contacts retained in the insulative housing 1, a metal shell 4 covering the insulative housing 1, and a metal cover 5 coupled to the metal shell 4.

Referring to FIGS. 1-4, the insulative housing 1 comprises a first housing 11 and a second housing 12 engaging with each other. The first housing 11 has a base portion 111, and a tongue plate 112 extending forwardly from a front face of the base portion 111 and being upright related to the PCB. The tongue plate 112 has a plurality of first slots 1121 recessed from a right side thereof and arranged in one row along a height direction of the electrical connector 100, and a plurality of second slots 1122 recessed from the right side and arranged in one row along the height direction. The second slots 1122 are located behind the first slots 1121. The second housing 12 has a plurality of posts 121 protruding from a left side thereof for being retained in retaining holes formed on a right side of the base portion 111, a plurality of first protrusions 122 protruding from the left side and arranged in one row along the height direction, and a plurality of second protrusions 123 protruding from the left side and arranged in one row along a front-to-back direction perpendicular to the height direction.

Referring to FIGS. 2-5, the contacts comprise a plurality of first contacts 2 insert-molded in the first housing 11 and a plurality of second contacts 3 assembled to the first housing 11. Each first contact 2 has a stiff first contacting portion 210 retained in the first slot 1121, a first tail portion 220 extending downwardly out of the base 11 for being mounted onto the PCB, and a first connecting portion connecting the first contacting portion 210 and the first tail portion 220. The first connecting portion comprises a first horizontal portion 21 offset sidewardly from the first contacting portion 210 and extending along the front-to-back direction, and a first vertical portion 22 perpendicular to the first horizontal portion 21 and connecting with the first tail portion 220. The first contacts 2 comprise a first pair of differential contacts 23, a second pair of differential contacts 24 and a grounding contact 25 located between the first and second pairs of differential contacts 23, 24. Each pair of the first and second pairs of differential contacts 23, 24 includes an upper contact 231, 241, and a lower contact 232, 242 located under the corresponding upper contact 231, 241. The first contacting portion 210 and first horizontal portion 21 of the lower contact 232, 242 are located under the corresponding contacting portion 210 and first horizontal portion 21 of the upper contact 231, 241. The first horizontal portion 21 of the lower contact 232, 242 has an offset portion 211 offsetting horizontally and extending backwardly beyond the first horizontal portion 21 of the corresponding upper contact 231, 241. The first vertical portion 22 of the lower contact 232, 242 has a length shorter than that of the first vertical portion 22 of the corresponding upper contact 231, 241, the first horizontal portion 21 of the lower contact 232, 242 has a length longer than that of the first horizontal portion 21 of the corresponding upper contact 231, 241, and total lengths of the lower and upper contacts 232, 242, 231, 241 of each pair of the first and second pairs of differential contacts 23, 24 are substantially equal. Therefore, each pair of the first and second pairs of differential contacts 23, 24 could transmit signals synchronously, and signal skew or out of timing sequence is avoided. The first vertical portions 22 of each pair of the first and second pairs of differential contacts 23, 24 are staggered with each other in both a transverse direction and the front-to-back direction. The first vertical portions 22 of the upper contacts 231, 241 and the grounding contacts 25 are arranged in a first row, the first vertical portions 22 of the lower contacts 232, 242 are arranged in a second row different from the first row.

The second contacts 3 are adapted for USB protocol and transmit signals same to the standard USB 2.0 receptacle. The second contacts 3 are positioned between the first and second housing 11, 12. Each second contact 3 has a second contacting portion 31 retained in the second slot 1122, a second tail portion 33 extending downwardly beyond the second housing 12 for being mounted onto the PCB, and a second connecting portion 32 connecting the second contacting portion 31 and the tail portions 33. The second connecting portion 32 includes a second horizontal portion 321 connecting the first contacting portion 31 and extending in the front-to-back direction, and a second vertical portion 322 perpendicular to the second horizontal portion 321 and connecting the second tail portion 33. The second horizontal portion 321 defines a first aperture 323 passing therethrough along the transverse direction and retained in the corresponding first protrusion 122, and the second vertical portion 322 defines a second aperture 324 passing therethrough along the transverse direction and retained in the corresponding second protrusion 123. Therefore the second contacts 3 could be retained in the second housing 12 firmly.

The metal shell 4 forms a receiving space 41 with the tongue plate 112 extending therein for receiving a corresponding plug (not shown) and fastens the first and second housings 11, 12 together.

Figure 6:
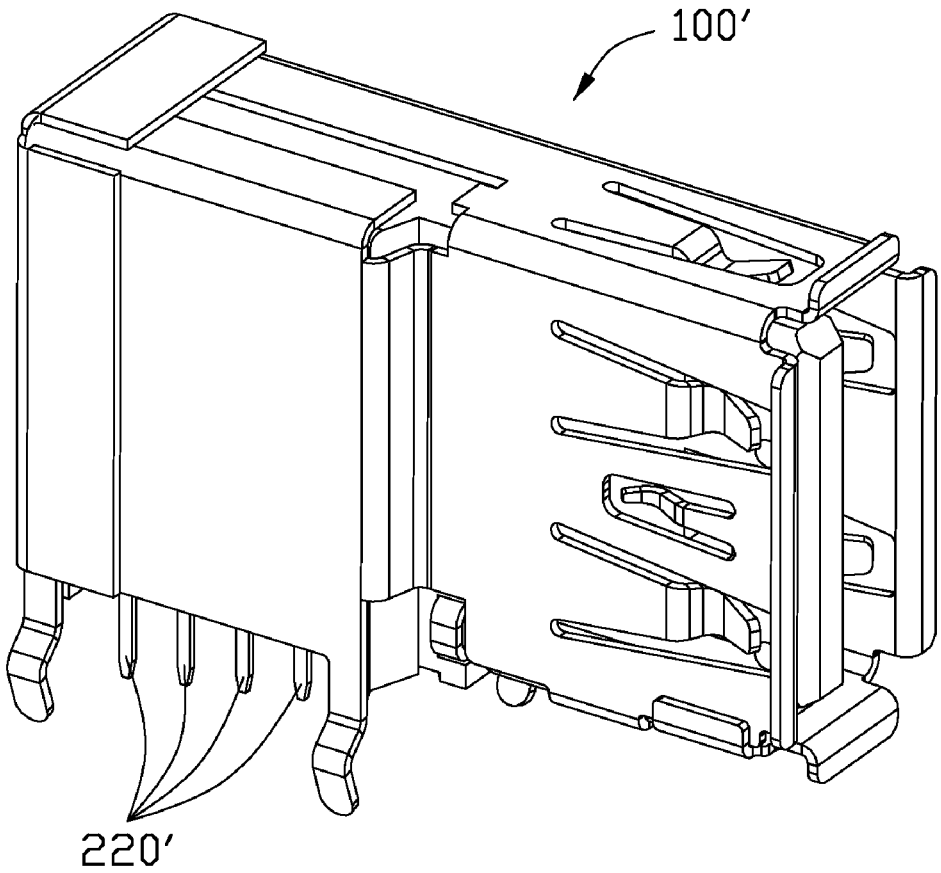
FIG. 6 is a perspective view of an electrical connector according to a second embodiment of the present invention.
Figure 7:
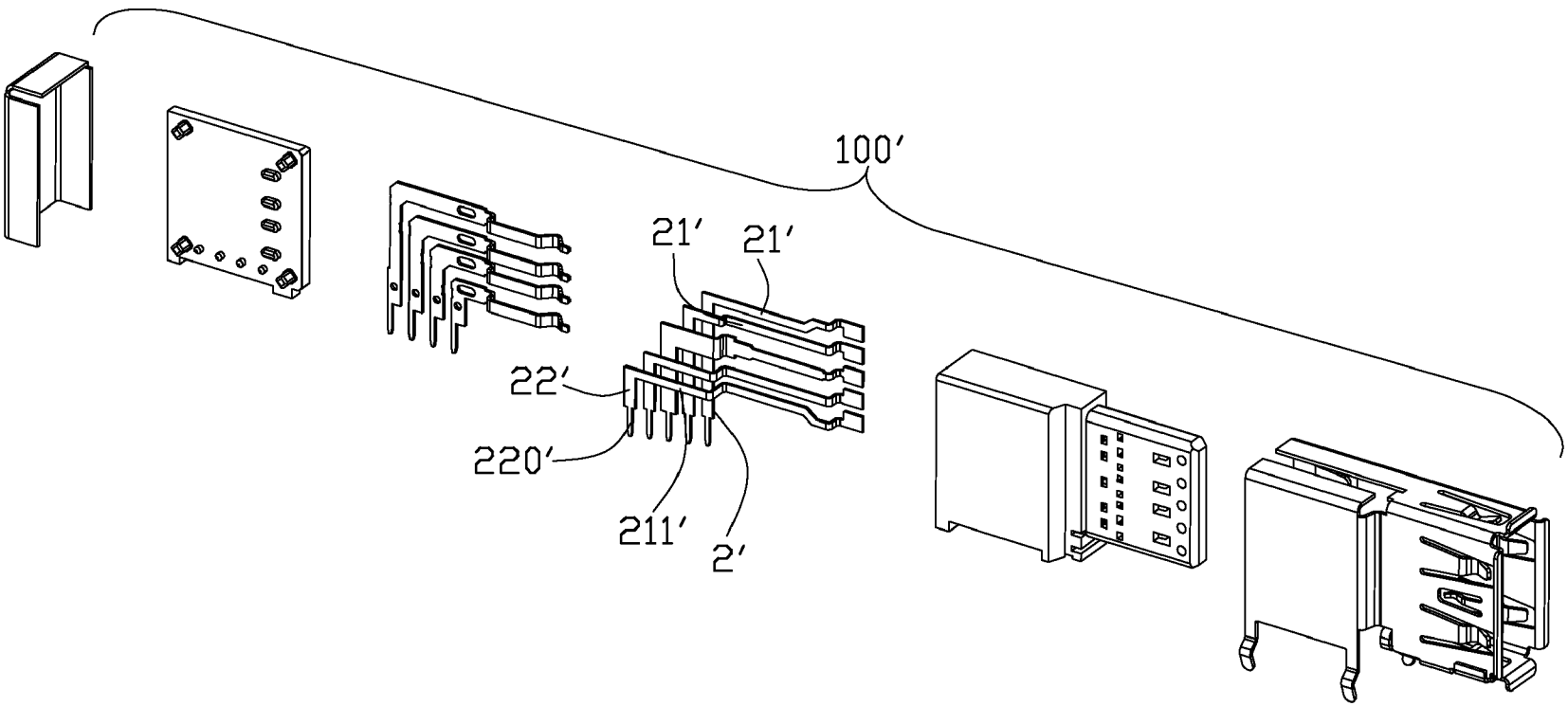
FIG. 7 is an exploded view of the electrical connector shown in FIG. 6.
Figure 8:
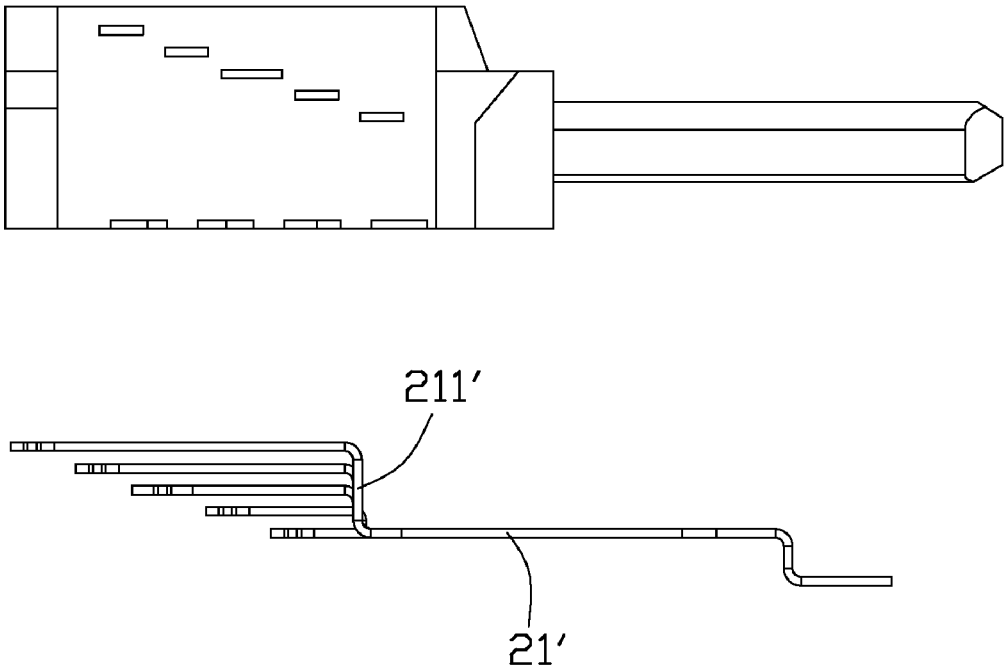
FIG. 8 is a bottom plan view of first contacts and first housing of the electrical connector shown in FIG. 6.
Figure 9:
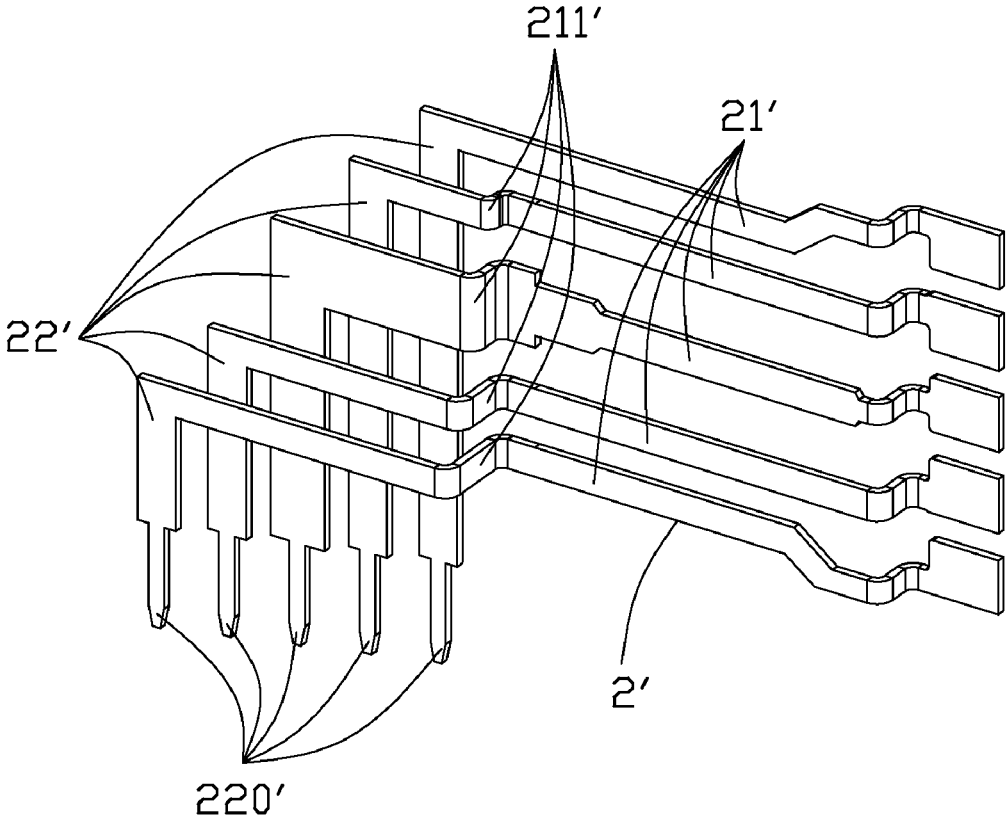
FIG. 9 is an enlarged view showing the first contacts of the electrical connector shown in FIG. 6.

Referring to FIGS. 6-9, an electrical connector 100' according to a second embodiment of the present invention is disclosed. In the first embodiment, the total length of each of the first pair of differential contacts 23 is different from the total length of each of the second pair of differential contacts 24. In this second embodiment, all of the first horizontal portions 21' except the upmost first horizontal portion 21' have offset portions 211' offset horizontally in varying degrees. The first vertical portion 22' and the tail portion 220' of the first contacts 2' are staggered with each other in both the transverse direction and the front-to-back direction. The lower the first contact 2' is located, the shorter length the first vertical portion 22' has, and the longer length the first horizontal portion 21' has, and total lengths of all of the first contacts 2' are substantially equal. Therefore, all of the first contacts 2' could transmit signals synchronously, and signal skew or out of timing sequence is avoided more effectively.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted onto a printed circuit board comprising:

an insulative housing defining a base portion sitting downwardly onto the printed circuit board, and a tongue plate extending forwardly from the base portion and being upright;

a metal shell covering the insulative housing and defining a receiving space with the tongue plate extending therein; and a plurality of first contacts retained in the insulative housing and defining first contacting portions attached to a lateral side of the tongue plate to be exposed to the receiving space and arranged in one row along a height direction of the electrical connector, first tail portions extending outwardly beyond the insulative housing for being mounted onto the printed circuit board, and first connecting portions connecting the first contacting portions and the first tail portions, the first contacts comprising, two pairs of differential contacts and a grounding contact located inbetween, each pair of differential contacts an upper contact and a lower contact located under the upper contact;

wherein total lengths of the upper and lower contacts are substantially equal.

2. The electrical connector according to claim 1, wherein the first connecting portion comprises a first horizontal portion extending backwardly from the first contacting portion along a front-to-back direction, and a first vertical portion perpendicular to the first horizontal portion and connecting the first tail portion, the first horizontal portion of the lower contact has an offset portion offsetting horizontally and extending backwardly beyond the first horizontal portion of the upper contact.

3. The electrical connector according to claim 2, wherein the first vertical portion of the lower contact has a length shorter than that of the first vertical portion of the upper contact, the first horizontal portion of the lower contact has a length longer than that of the first horizontal portion of the upper contact.

4. The electrical connector according to claim 2, wherein the first vertical portions of the upper and lower contacts are staggered with each other in both the front-to-back direction and a transverse direction perpendicular to the front-to-back direction.

5. The electrical connector according to claim 1, wherein the first contacts further comprise a second pair of differential contacts located under the first pair of differential contacts, and a grounding contact located between the first and second pairs of differential contacts, the second pair of differential contacts include an upper contact, and a lower contact located under the upper contact and having a total length substantially equal to that of the upper contact.

6. The electrical connector according to claim 5, wherein the first vertical portions of the upper contacts of the first and second pairs of differential contacts and the grounding contact are arranged in a first row along a front-to-back direction, the first vertical portions of the lower contacts of the first and second pairs of differential contacts are arranged in a second row along the front-to-back direction and different from the first row.

7. The electrical connector according to claim 5, wherein total lengths of all of the first contacts are substantially equal.

8. The electrical connector according to claim 5, wherein all of the first horizontal portions except the first horizontal portion of the upmost first contact have offset portions offsetting horizontally in varying degrees, the lower the first contact is located, the shorter length the first vertical portion has, and the longer length the first horizontal portion has.

9. The electrical connector according to claim 8, wherein the first vertical portions of all of the first contacts are staggered with each other in both a front-to-back direction and a transverse direction perpendicular to the front-to-back direction.

10. The electrical connector according to claim 1, further comprising a plurality of second contacts defining second contacting portions attached to the same side of the tongue plate as the first contacting portions and arranged in one row behind the first contacting portions, second tail portions extending outwardly beyond the insulative housing for being mounted onto the printed circuit board, and second connecting portions connecting the second contacting portions and the second tail portions; where the insulative housing comprising a first housing defining the base portion and the tongue plate, and a second housing coupled to the first housing, the first contacts being insert-molded in the first housing, the second contacts being assembled between the first and second housings.

11. The electrical connector according to claim 9, wherein the second connecting portions include second horizontal portions extending backwardly from the second contacting portions along the front-to-back direction, and second vertical portions perpendicular to the second horizontal portions and connecting the second tail portions, each second horizontal portion defines a first aperture passing therethrough along a transverse direction, each second vertical portion defines a second aperture passing therethrough along the transverse direction, the second housing has a plurality of posts protruding therefrom for being retained in holes formed on the base portion, a plurality of first protrusions arranged in one row along the height direction for being received in the corresponding first apertures, and a plurality of second protrusions arranged in one row along a front-to-back direction for being received in the corresponding second apertures.

12. An upright electrical connector for being mounted onto a printed circuit board comprising:

an insulative housing defining a base portion and a tongue plate extending forwardly from the base portion;

a plurality of first contacts defining first contacting portions retained in the tongue plate and arranged in one row along a height direction of the electrical connector, first tail portions extending outwardly beyond the insulative housing for being mounted onto the printed circuit board, and first connecting portions connecting the first contacting portions and the first tail portions, the first connecting portions having first horizontal portions extending backwardly from the first contacting portions along a front-to-back direction, and first vertical portions perpendicular to the first horizontal portions and connecting the first horizontal portions and the first tail portions, the first contacts comprising two pairs of differential contacts and a grounding contact located therebetween, each pair of differential contacts including an upper contact and a lower contact located under the upper contact;

wherein the first horizontal portion of the lower contact has a length longer than that of the first horizontal portion of the corresponding upper contact, the first vertical portion of the lower contact has a length shorter than that of the first vertical portion of the corresponding upper contact, in each pair of differential contacts, the upper contact has a total length substantially equal to that of the lower contact; and a metal shell covering the insulative housing.

13. The upright electrical connector according to claim 12, wherein the first horizontal portion of the lower contact has an offset portion offsetting horizontally and extending backwardly beyond the first horizontal portion of the corresponding upper contact.

14. The upright electrical connector according to claim 13, wherein the first vertical portions of the upper and lower contacts are staggered with each other in both the front-to-back direction and a transverse direction perpendicular to the front-to-back direction.

15. The upright electrical connector according to claim 13, wherein the first vertical portions of all of the first contacts are staggered with each other in both the front-to-back direction and a transverse direction perpendicular to the front-to-back direction, total lengths of all of the first contacts are substantially equal.

16. A vertical type electrical connector comprising:

an insulative housing defining an upstanding mating tongue along a front-to-back direction;

a plurality of differential pairs disposed in the housing with corresponding horizontal contacting sections upon a same mating face of the mating tongue and arranged in sequence in a vertical direction perpendicular to said front-to-back direction, and with corresponding tail sections essentially extending downwardly from a rear end of the corresponding contacting sections, respectively; wherein in each of said differential pairs, the one with the corresponding contacting section at a higher level defines the corresponding tail section closer to the corresponding contacting section in a transverse direction perpendicular to both said front-to-back direction and said vertical direction, than the corresponding tail section of the other compared to the corresponding contacting section of the other so as to have a whole length of said one is generally equal to that of the other, wherein the plurality of differential pairs comprise two pairs of differential contacts and a grounding contact located inbetween, each pair of differential contacts having an upper contact and a lower contact under the upper contact.

17. The vertical type electrical connector as claimed in claim 16, further includes another set of contacts having corresponding resilient contacting portions exposed upon the same mating face while having corresponding tail portions have a same distance with regard to the corresponding contacting portions in said transverse direction.

18. The vertical type electrical connector as claimed in claim 16, wherein said differential pairs have two differential pairs, and said two differential pairs define different whole lengths under condition that said the corresponding tail sections of the contact having the upper contacting sections are located in one same row and those of the contact having the lower contacting sections are located in another same row.

19. The vertical type electrical connector as claimed in claim 16, wherein said differential pairs have two differential pairs, and said two different pairs essentially have the same whole length under condition that the tail sections of both said contacts are located at different rows.

* * * * *